US009254004B2

(12) United States Patent
Lena

(10) Patent No.: US 9,254,004 B2
(45) Date of Patent: Feb. 9, 2016

(54) METHOD FOR MAKING HINGED-LID PACKETS

(71) Applicant: SASIB S.p.A., Castel Maggiore (Bologna) (IT)

(72) Inventor: Matteo Lena, Bologna (IT)

(73) Assignee: SASIB S.P.A. (IT)

( * ) Notice: Subject to any disclaimer, the term of this patent is extended or adjusted under 35 U.S.C. 154(b) by 21 days.

(21) Appl. No.: 14/093,880

(22) Filed: Dec. 2, 2013

(65) Prior Publication Data

US 2014/0151251 A1 Jun. 5, 2014

(30) Foreign Application Priority Data

Dec. 5, 2012 (IT) ..... BO2012A0659

(51) Int. Cl.

| | |
|---|---|
| ***B65B 19/04*** | (2006.01) |
| ***A24F 15/12*** | (2006.01) |
| ***B65D 5/66*** | (2006.01) |
| ***B65B 19/20*** | (2006.01) |
| ***B65B 19/24*** | (2006.01) |
| ***B65D 85/10*** | (2006.01) |

(52) U.S. Cl.

CPC ..... *A24F 15/12* (2013.01); *B65B 19/20* (2013.01); *B65B 19/24* (2013.01); *B65D 5/662* (2013.01); *B65D 85/1045* (2013.01)

(58) Field of Classification Search

CPC ..... A24C 15/12; B65B 19/22; B65B 19/34; B65B 19/10; B65B 19/12; B65B 19/20; B65B 11/42; B65B 11/54; B65B 11/28; B65B 11/30; B65B 11/32; B65B 5/04; B65B 25/04

USPC ..... 53/174, 207, 225, 232–234, 444, 449, 53/462, 464, 466, 465

See application file for complete search history.

(56) References Cited

U.S. PATENT DOCUMENTS

| | | | | |
|---|---|---|---|---|
| 2,468,543 | A | 4/1949 | Chalmers | |
| 3,802,325 | A * | 4/1974 | Bardenhagen et al. | 493/17 |
| 4,056,047 | A * | 11/1977 | Grimm | 493/151 |
| 5,755,080 | A * | 5/1998 | Draghetti et al. | 53/466 |
| 6,189,296 | B1 * | 2/2001 | Spatafora et al. | 53/461 |
| 7,155,882 | B2 * | 1/2007 | Ghini et al. | 53/444 |

(Continued)

FOREIGN PATENT DOCUMENTS

| | | |
|---|---|---|
| DE | 10 2010 035938 | 3/2012 |
| EP | 0481305 | 2/1995 |

(Continued)

OTHER PUBLICATIONS

Italian Search Report dated Aug. 21, 2013 from counterpart app No. EO2012A000659.

*Primary Examiner* — Robert Long

(74) *Attorney, Agent, or Firm* — Timothy J. Klima; Shuttleworth & Ingersoll, PLC

(57) ABSTRACT

A blank for hinged-lid packets for smoking articles comprises four panels extending side by side in pairs along a direction perpendicular to a direction of longitudinal extension of the packets obtainable from the blank; the blank is foldable along folding lines made between the pairs of panels and parallel to said direction of longitudinal extension, and an upper portion of one of the four panels is integral, on the outside of the selfsame four panels, with a portion forming the hinged lid of the respective packet. Also described is a method for making hinged-lid packets for smoking articles.

10 Claims, 10 Drawing Sheets

(56) References Cited

U.S. PATENT DOCUMENTS

| | | | | |
|---|---|---|---|---|
| 7,563,221 | B2 * | 7/2009 | Polloni et al. | 53/234 |
| 8,733,067 | B2 * | 5/2014 | Draghetti | B65B 19/223 53/148 |
| 8,826,633 | B2 * | 9/2014 | Buse | B65B 19/20 53/375.9 |
| 2002/0020150 | A1 * | 2/2002 | Spatafora | 53/466 |
| 2003/0093977 | A1 * | 5/2003 | Brizzi et al. | 53/444 |
| 2004/0261368 | A1 * | 12/2004 | Focke et al. | 53/449 |
| 2006/0005514 | A1 * | 1/2006 | Gamberini et al. | 53/444 |
| 2006/0010838 | A1 * | 1/2006 | Ghini et al. | 53/444 |
| 2006/0254212 | A1 * | 11/2006 | Ghini et al. | 53/148 |
| 2007/0130888 | A1 * | 6/2007 | Osti et al. | 53/466 |
| 2008/0016822 | A1 * | 1/2008 | Polloni et al. | 53/150 |
| 2009/0288371 | A1 * | 11/2009 | Squarzoni et al. | 53/456 |
| 2010/0287890 | A1 * | 11/2010 | Polloni et al. | 53/461 |
| 2011/0232236 | A1 | 9/2011 | Chatelain et al. | |
| 2011/0233080 | A1 * | 9/2011 | Bertuzzi et al. | 206/268 |
| 2012/0006823 | A1 * | 1/2012 | Bertuzzi et al. | 220/270 |
| 2012/0137633 | A1 * | 6/2012 | Bertuzzi et al. | 53/410 |
| 2013/0153449 | A1 | 6/2013 | Agirbas | |
| 2014/0151251 | A1 * | 6/2014 | Lena | 206/268 |
| 2015/0027916 | A1 * | 1/2015 | Buse | 206/268 |

FOREIGN PATENT DOCUMENTS

| | | |
|---|---|---|
| GB | 2063811 | 6/1981 |
| WO | 02/40379 | 5/2002 |
| WO | 2007091029 A1 | 8/2007 |
| WO | 2012/082907 | 6/2012 |
| WO | 2012/119611 | 9/2012 |

* cited by examiner

" PRIOR ART "

METHOD FOR MAKING HINGED-LID PACKETS

This application claims priority to Italian Patent Application BO2012A000659 filed Dec. 5, 2012, the entirety of which is incorporated by reference herein.

BACKGROUND OF THE INVENTION

This invention relates to a blank for hinged-lid packets for smoking articles and to a method for making such packets.

More specifically, this invention relates to a blank which can be used to make substantially parallelepiped-shaped, hinged-lid packets for containing smoking articles consisting of cigarettes or cigarette packets, and to a method for making such packets.

In this specification, reference is made by way of example, and for simplicity of description, to hinged-lid cigarette packets without thereby limiting the scope of the invention.

The blanks most frequently used to make packets of the above mentioned type are made of paperboard, have their longest dimension running parallel to the vertical edges of the packets concerned and are first folded around respective groups of cigarettes wrapped in metallized paper about a plurality of folding lines perpendicular to their longest dimension. A plurality of flaps and lateral panels of these blanks are then folded about folding lines parallel to the longest dimension in order to complete packet closure. The packets thus obtained have a bottom containing body portion, which houses the cigarettes, and a hinged lid located above the containing body portion for the closing thereof. An example of blanks of this kind is shown in patent U.S. Pat. No. 2,468,543A.

A longitudinal end portion of these blanks normally consists of a reinforcement flap which is folded towards the inside of the lid in order to strengthen it and so that lower front edge of the lid visible to the smoker is defined by a folded paperboard portion and not a cut portion of the blank, considered aesthetically unattractive.

In some types of packing machines which make packets of the type mentioned above, the blanks used have their longest dimension perpendicular to the vertical edges of the packets concerned. The blanks of this kind are first folded around respective groups of cigarettes wrapped in metallized paper about a plurality of folding lines parallel to the vertical edges, and a plurality of lower and upper panels and flaps are then folded about folding lines parallel to the longest dimension in order to complete packet closure. A blank of this kind is illustrated, for example, in patent GB2063811A which protects a packing machine for making packets of the type described.

The packing machines used for handling blanks of this kind are relatively simple compared to those used for making packets from blanks of the first type described above, but the packets obtained do not have the lid reinforcement flap because the shape of the blanks is such that the edges of the lid are geometrically contained within the body of the blanks themselves and there is not enough space in the body of the blanks to make the reinforcement flap.

As a result, the lower front edge of the lid of these packets is not defined by a folded paperboard portion and instead the smoker sees a cut portion of the blank, with a relatively unpleasant visual effect.

Moreover, packets of this kind do not have what is known as the "inner frame" between the respective blanks and the groups of cigarettes wrapped in metallized paper. The inner frame, besides having an important aesthetic function, also keeps the lid well closed when the packet is not being used. The absence of the inner frame thus gives packets of this kind unpleasant aesthetic features and poor functional features.

SUMMARY OF THE INVENTION

This invention has for an aim to provide a blank for hinged-lid packets for smoking articles and whose features are such that it can be handled by packing machines designed to use the second type of blank described above but having the above mentioned lid reinforcement flap so as to make packets in which the lid is adequately reinforced and aesthetically pleasant.

Also, preferably, the packets made using the blanks according to this invention are provided with an inner frame and therefore have very good functional features.

A further aim of this invention is to provide a method for making, in a relatively simple and inexpensive manner, packets from blanks of the second type described above, where the lid has the above mentioned reinforcement flap and which are preferably provided with an inner frame.

This invention accordingly provides a blank for hinged-lid packets for smoking articles and a method for making such packets as set out in the accompanying claims.

BRIEF DESCRIPTION OF THE DRAWINGS

The invention is described below with reference to the accompanying drawings, which illustrate a non-limiting embodiment of it, and in which.

DESCRIPTION OF THE PREFERRED EMBODIMENTS

Figure 1:
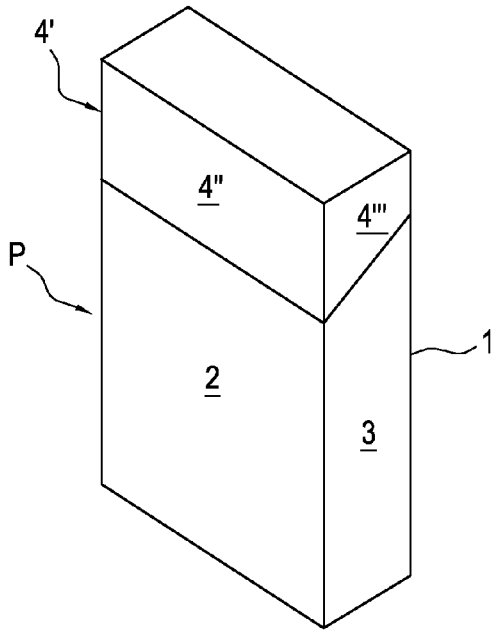
FIGS. 1 and 1*a* are two perspective views of a cigarette packet, with the lid closed and open, respectively, made using the blanks and the packing machine of this invention.

With reference to FIG. 1, the reference character P denotes a hinged-lid cigarette packet substantially in the shape of a parallelepiped. The packet P comprises two opposite large faces, that is, a rear panel 1 and a front panel 2, which are also identifiable in the blank S of FIG. 1*a* and which are joined to each other by a lateral panel 3 through weakened folding lines. A further lateral panel 4 is connected laterally to the front panel 2 through a weakened line, and a panel 5, similar to the panel 4 but narrower, is connected laterally to the lateral panel 1 through a further weakened folding line. The front panel 2, the lateral panel 3 and the lateral panel 4 each comprise a lower portion partly defining the body of the packet P, separated from an upper portion or lid 4' of the packet P by a crease line 6. The upper portion 4' is defined by a rectangular central portion 4" and right-angled trapezoidal portions 4'" connected to respective lateral edges of the rectangular central portion 4". Extending respectively upwards and downwards from the front panel 2 and the rear panel 1, there are two inner and outer flaps, rectangular in shape and labeled 7 and 8 respectively. Similarly, extending respectively upwards and downwards from the panels 3 and 4, there are two rectangular end flaps, labeled 10 and 11 respectively.

When the packet is completed, the flaps 10 and 11, located respectively at the top and at the bottom, are folded squarely towards each other and towards the inside of the packet P, the end flaps 7 and 8, located respectively at the top and at the bottom, are also folded squarely to overlap each other and are connected to each other by glue, and the lid 4' is hinged to the rear panel 1 about a weakened line 9.

The blank S just described in combination with the packet P is of known type and, more precisely, is very similar to the one described in the introduction to this specification with reference to patent GB2063811A.

Figure 2:
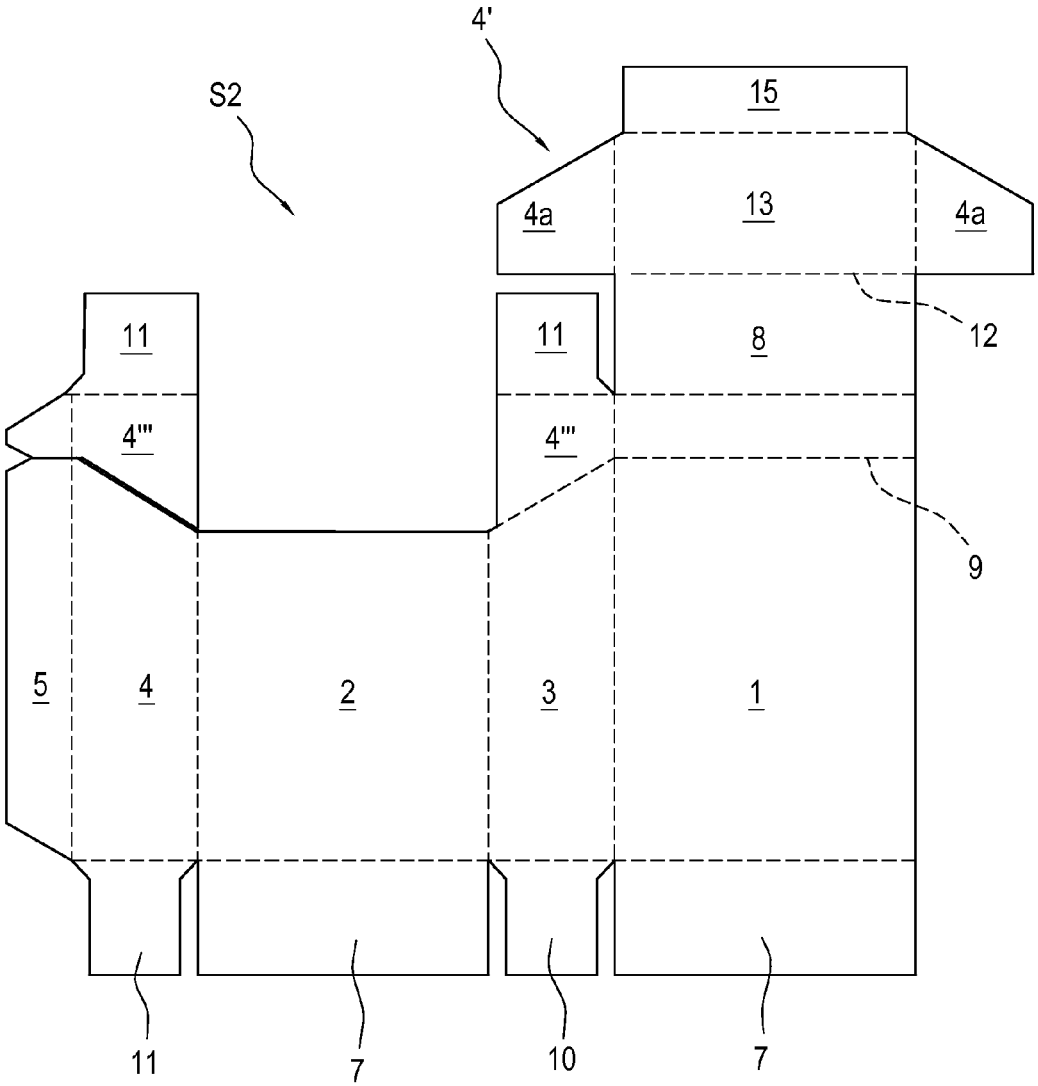
FIGS. 2-5 illustrate four preferred embodiments of the blank of the invention.

With reference to FIG. 2, the reference label S2 denotes in its entirety a blank made according to this invention and used to make the packet P described above with reference to FIG. 1.

The portions of the blank S2 also present in the blank S are labeled, where possible, with the same reference characters as those used in the description of the selfsame blank S.

The blank S2 differs from the blank S described above firstly in that it does not have the central rectangular portion 4" and the outer end flap 7 above it and in that the panel 5 is connected laterally to the panel 4 and not to the panel 1.

Also, in the blank S2, the upper horizontal edge of the end flap 8, above the weakened line 9, has connected to it through a weakened line 12 a rectangular panel 13 which is the same size as the above mentioned central rectangular portion 4", and the upper horizontal edge of the rectangular panel 13 has connected to it, through a further weakened line 14, a further rectangular panel 15 which is equal in width to the rectangular panel 13 but smaller in height.

Connected respectively to the two vertical sides of the rectangular panel 13 are the major bases of two right-angled trapezoidal flaps 4*a* whose respective inclined sides are located at the top. As will become clearer as this description continues, the panel 8 above the weakened line 9, the rectangular panels 13 and 15 and the trapezoidal flaps 4*a* make up the lid 4' of the packet P, and thus constitute a portion of the blank S2 forming the hinged lid 4' and this consideration also applies to the variant embodiments of the blank S2 described below.

As illustrated in FIG. 2 and as described above, the panels 1, 2, 3, 4 extend side by side in pairs along a direction perpendicular to a direction of longitudinal extension of the packets P obtainable from the blank S2. Further, the blank S2 is foldable along folding lines made between the pairs of panels 1, 2, 3, 4 and parallel to said direction of longitudinal extension of the packets P obtainable from the blank S2. These considerations also apply to the variant embodiments of the blank S2 described below.

Figure 1A:
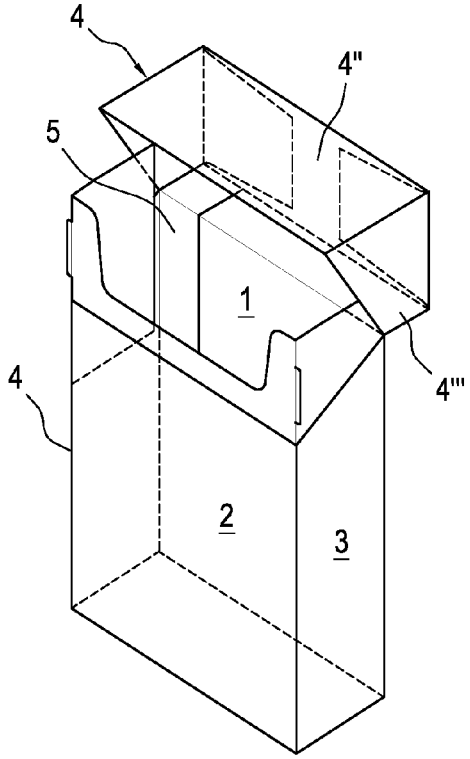
Figure 1B:
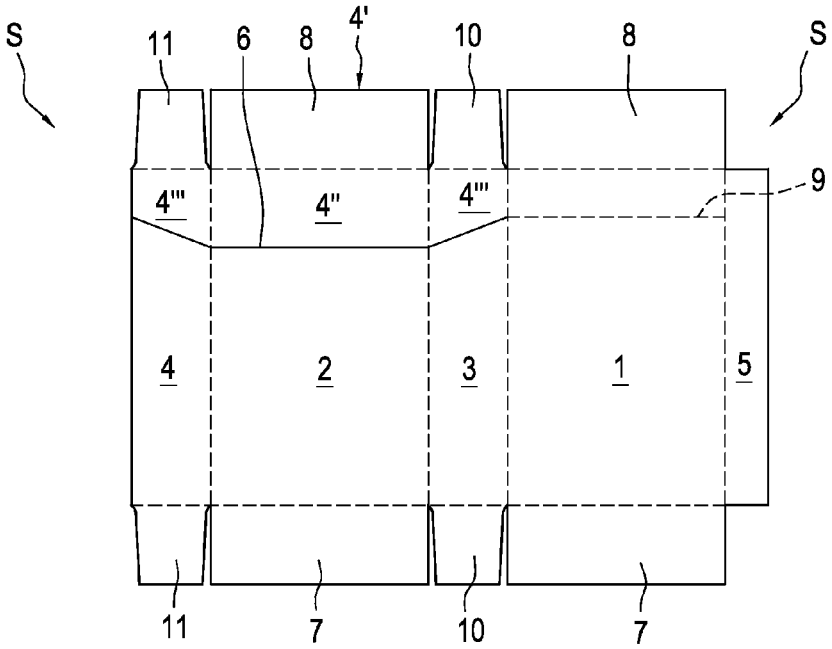
FIG. 1*b* illustrates a blank of known type to which reference is made in the introduction to this specification.

As may be noticed in FIG. 1*a*, when the packet P obtained from the blank S2 is fully formed, the panel 1 is superposed on and connected to the panel 5, which is thus located at a rear lateral inside portion of the packet P when assembled. This constitutes an important aesthetic feature which gives the packets P obtained from the blank S2 an appreciably better appearance than that of packets made using the blank S described previously.

Figure 3:
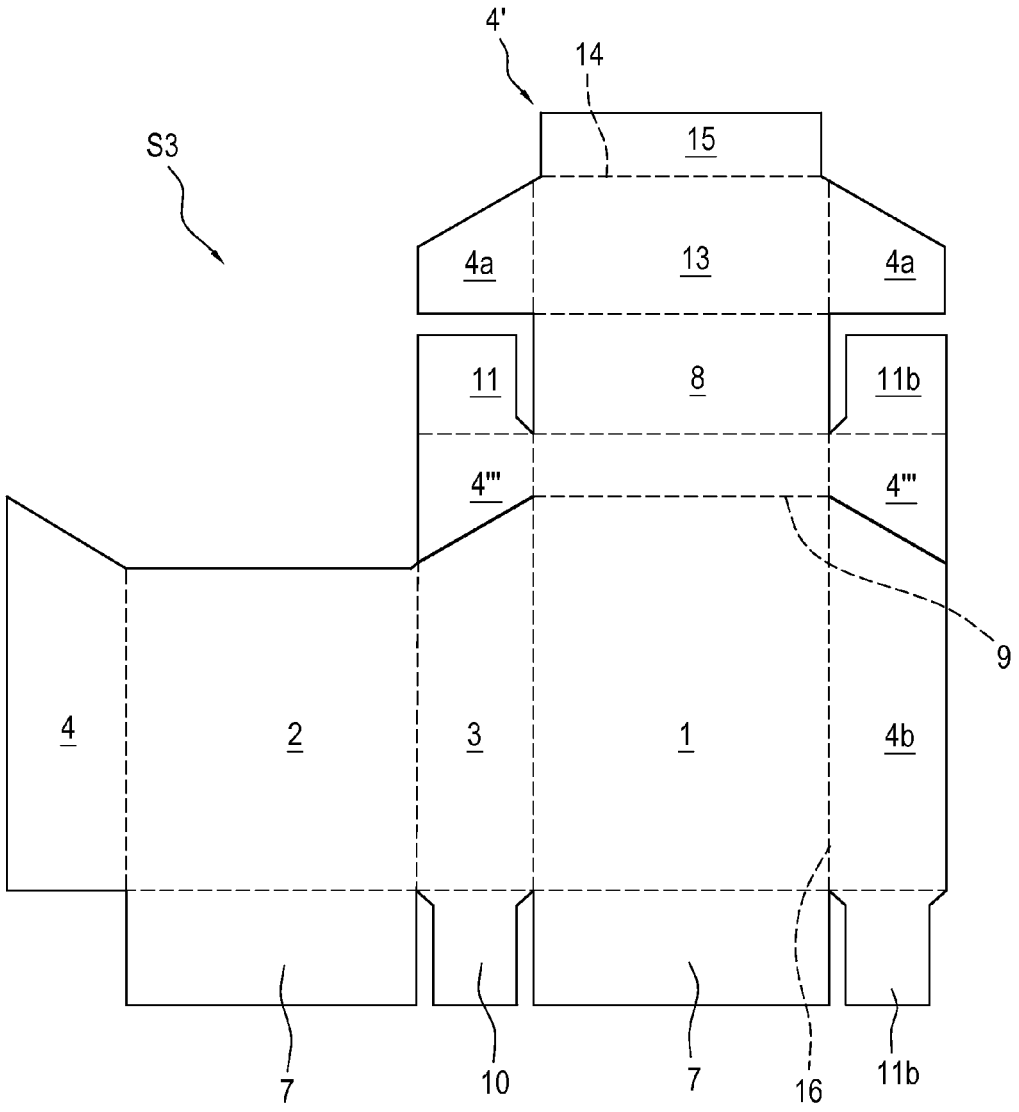

With reference to FIG. 3, the reference label S3 denotes in its entirety a blank made according to this invention and used to make the packet P described above with reference to FIG. 1.

The portions of the blank S3 also present in the blank S2 are labeled, where possible, with the same reference characters as those used in the description of the selfsame blank S2.

The blank S3 differs from the blank S2 of FIG. 2 firstly in that it does not have the right-angle trapezoidal flap 4''' on the left and the flap 11 above it.

Also, the blank S3 does not have the wall or side 5 which is present on the left in the blank S2 of FIG. 2, whilst the edges on the right of the rear panel 1 and of the end flaps 8 have respectively connected to them, through a vertical weakened line 16, a panel 4*b* and two end flaps 11*b* (the upper one above a right-angled trapezoidal portion 4''') equal in shape and reciprocal arrangement to the panel 4 and the end flaps 11 of the blank S, respectively.

Figure 4:
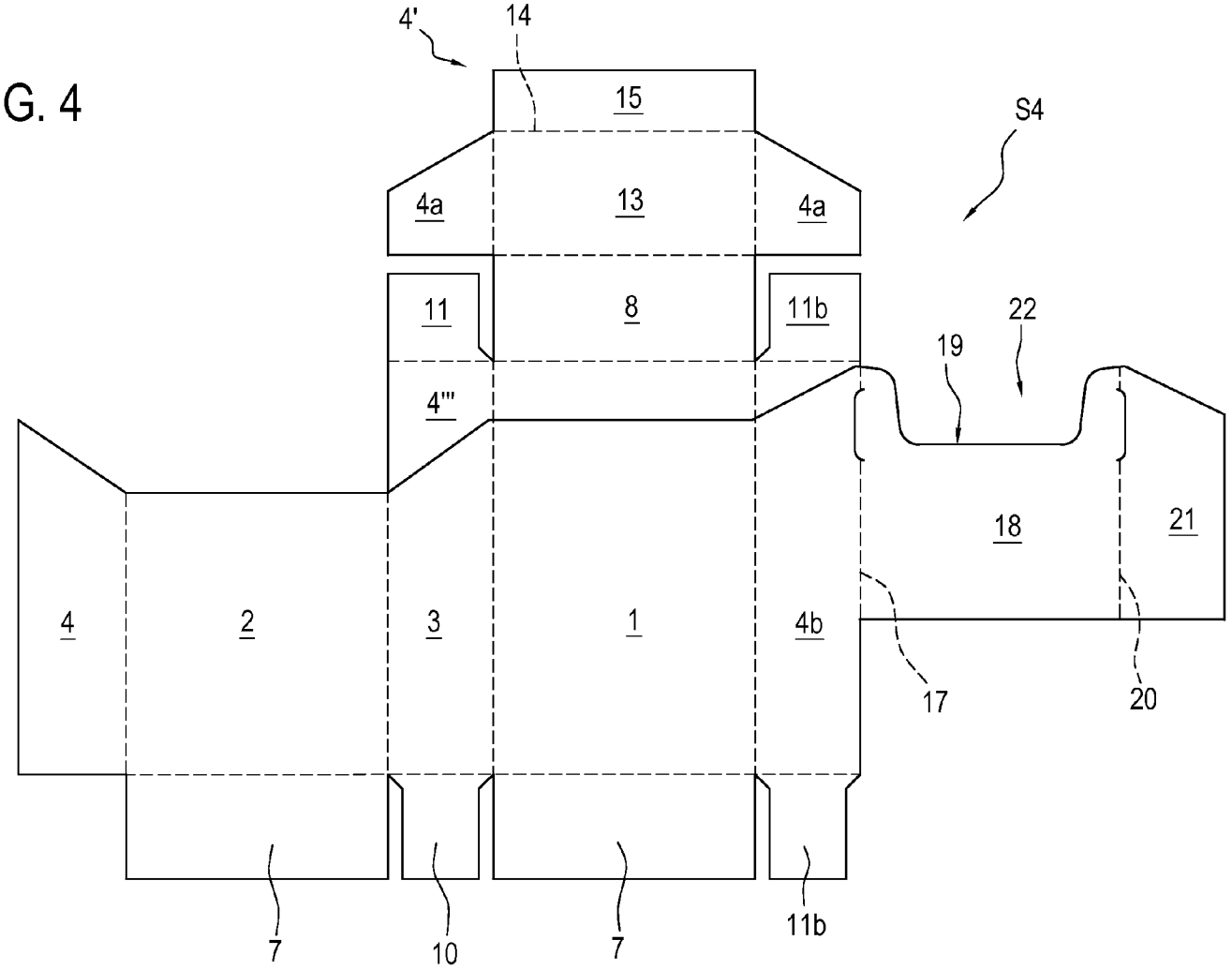
Figure 4A:
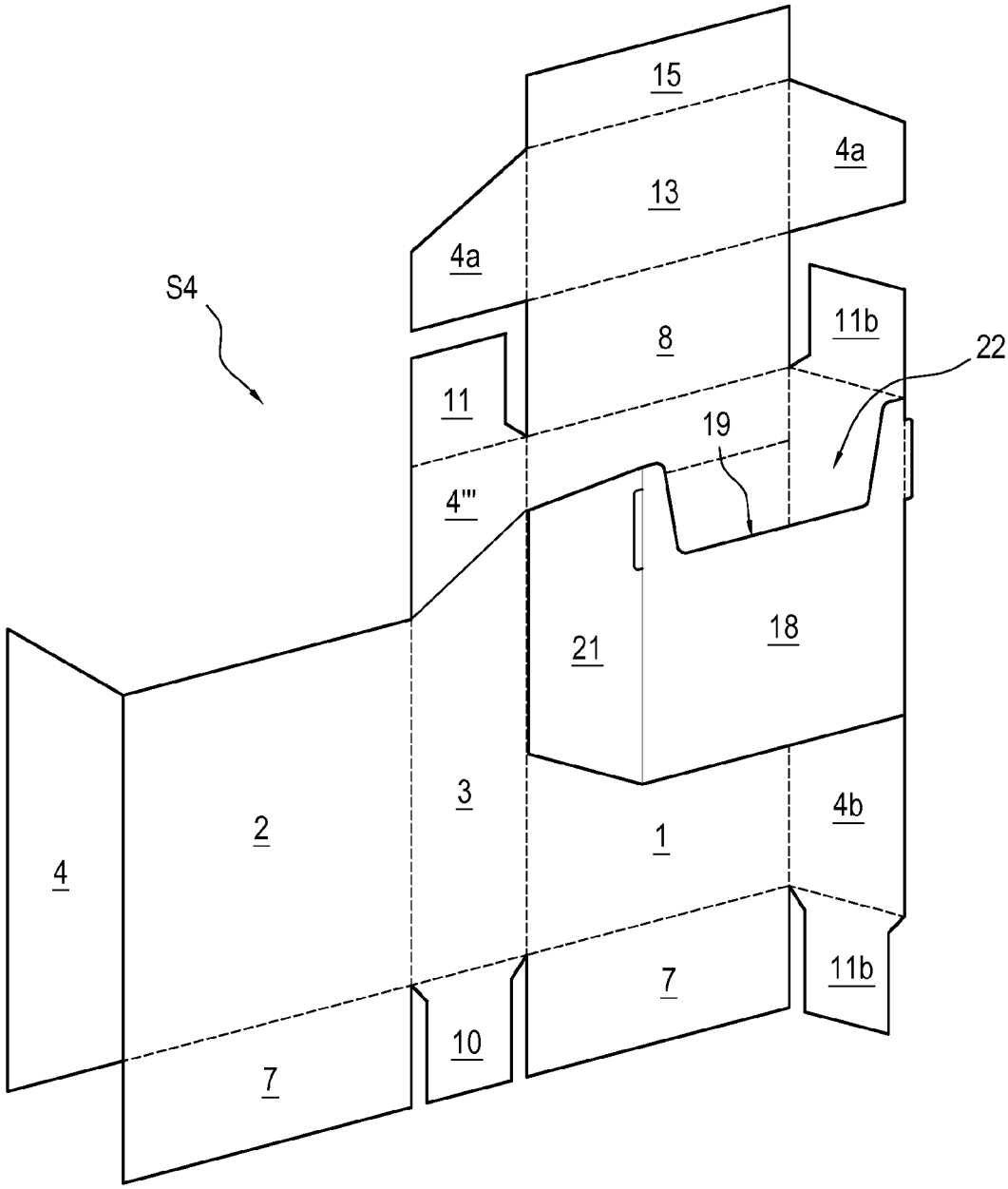
FIGS. 4*a* and 5*a* illustrate the blanks of FIGS. 4 and 5, respectively, partly folded to form the packet of FIG. 1.

With reference to FIG. 4, the reference label S4 denotes in its entirety a blank made according to this invention and used to make the packet P described above with reference to FIG. 1.

The portions of the blank S4 also present in the blank S3 are labeled, where possible, with the same reference characters as those used in the description of the selfsame blank S3.

The blank S4 differs from the blank S3 of FIG. 3 only in that an upper right-hand portion of the panel 4*b* has connected to it, through a weakened line 17, a substantially rectangular panel 18, a central portion of whose upper edge is provided with a substantially rectangular indentation 19 with rounded corners. A right-hand edge of the panel 18 has connected to it, through a weakened line 20, the major base of a right-angled trapezoidal panel 21, an upper side of which is inclined.

The panel 18, together with the trapezoidal panel 21 and the upper right-hand portion of the panel 4*b*, as will become dearer as this description continues, forms what is known as the internal element or "inner frame" 22 of the packet 1 made from the blank S4. In other words, and in more general terms, an inner frame 22 or internal element of the packet P obtainable from the blank S4 is connected to a lateral portion of one of the four panels 1, 2, 3, 4 through a weakened folding line, and this consideration also applies to the variant embodiment of the blank S4 described below.

Figure 5:
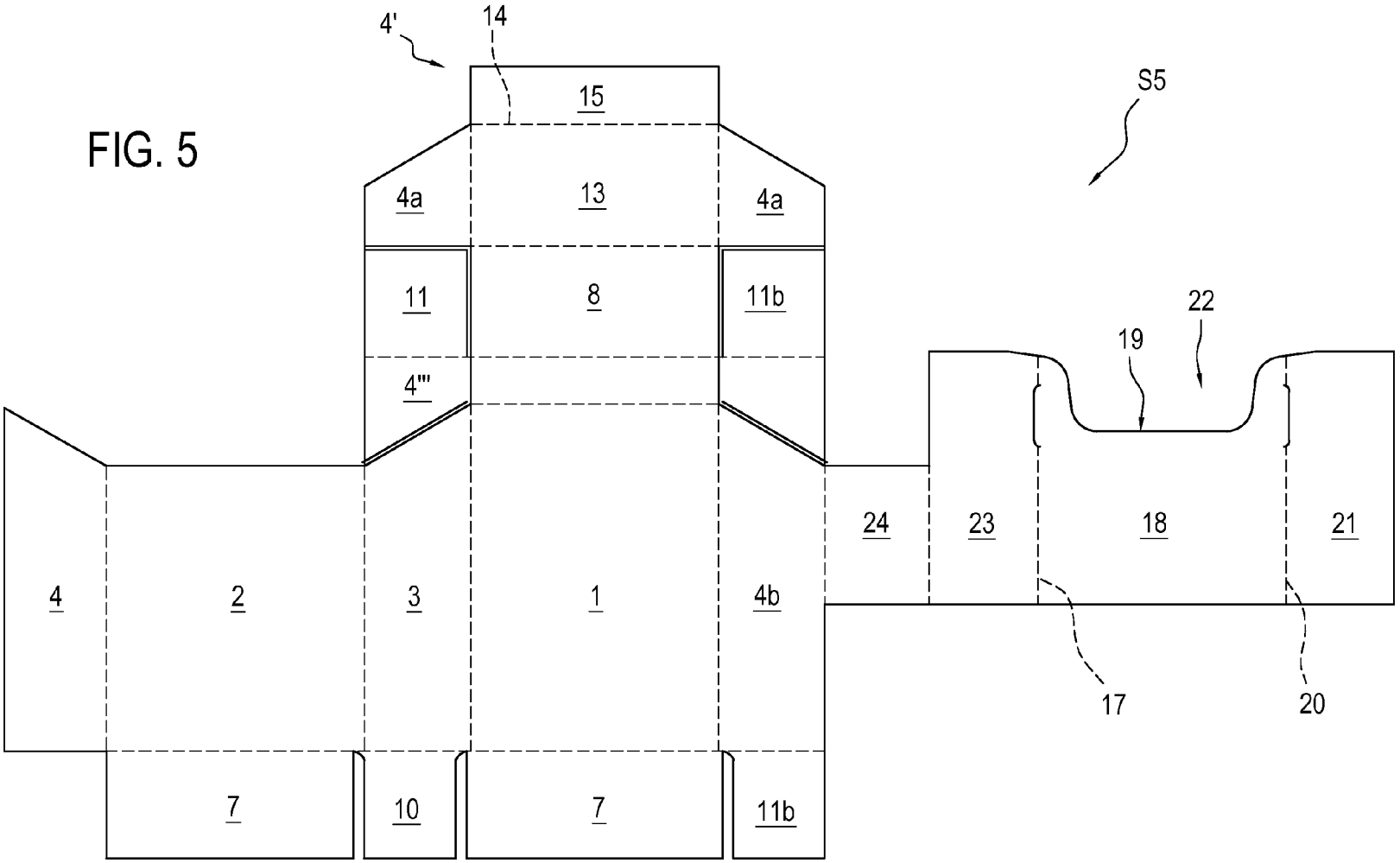

With reference to FIG. 5, the reference label S5 denotes in its entirety a blank made according to this invention and used to make the packet P described above with reference to FIG. 1.

The portions of the blank S5 also present in the blank S4 are labeled, where possible, with the same reference characters as those used in the description of the selfsame blank S4.

The blank S5 differs from the blank S4 of FIG. 4 in that the assembly made up of the panel 18 and the panel 21 is connected to the panel 4 adjacent to the panel 1 through a panel 23 made mirror symmetrically about the panel 21 and a rectangular connecting panel 24 which joins the panels 23 and 4*b*. The lines which separate the panels 21, 18, 23, 24 and 4*b* are weakened lines.

Figure 6:
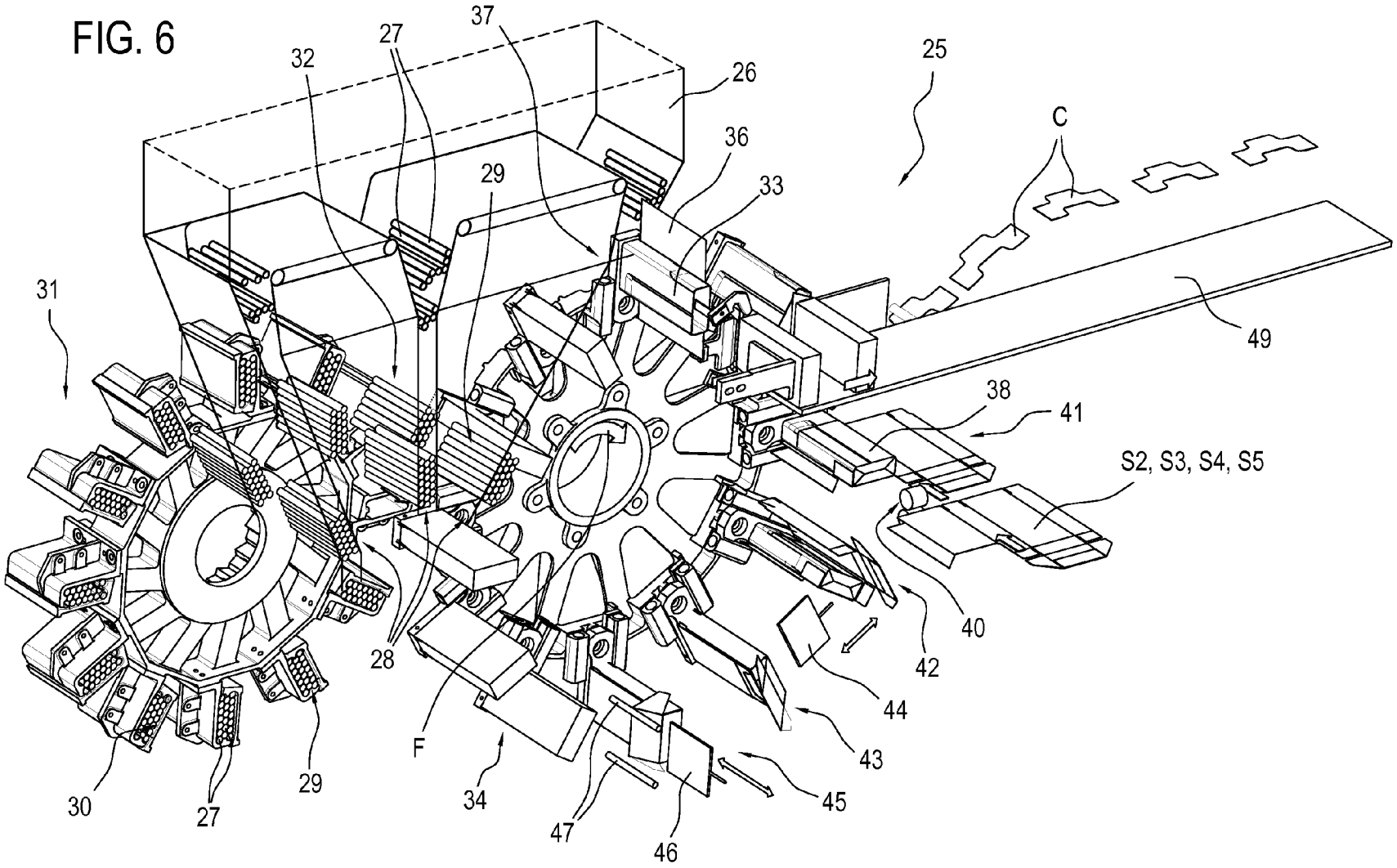
FIG. 6 is a perspective view of a portion of a packing machine designed to make the cigarette packet of FIG. 1.
Figure 7:
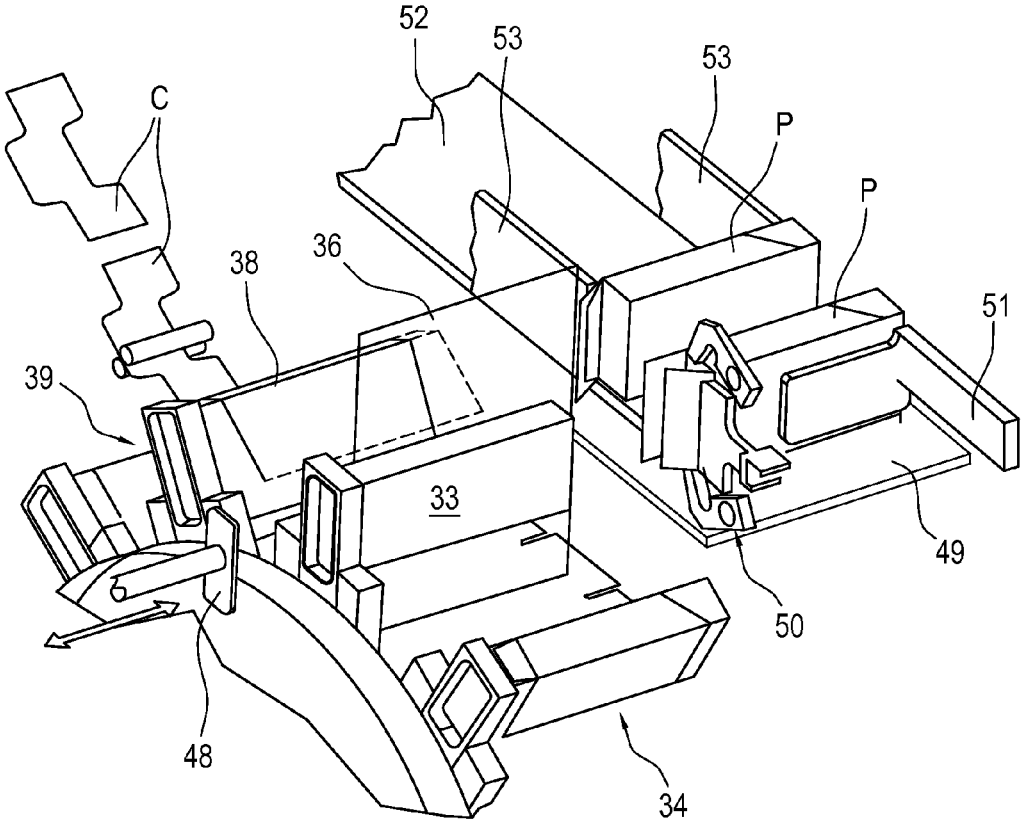
FIG. 7 shows details of the packing machine of FIG. 6 in a perspective view.

With reference to FIGS. 6 and 7, the numeral 25 denotes a packing machine (only partly illustrated) designed to make the cigarette packets P of FIG. 1.

The packing machine 25 has many components in common with the machine illustrated and described in patent EP481305B1, which is incorporated herein by reference for completeness of description, and comprises a hopper 26 for feeding cigarettes 27 and equipped at the bottom of it with three outlet openings 28 placed side by side in pairs and able to deliver in succession groups 29 of cigarettes 27 into respective, angularly equispaced peripheral compartments 30 of a wheel 31 rotatable stepwise in an anticlockwise direction (in the example illustrated) about a horizontal axis.

Each time the wheel 31 completes three rotational steps, each having an amplitude corresponding to the angular step of two consecutive compartments 30 of the wheel 31, three pusher elements (not illustrated and of essentially known type) which move intermittently in a horizontal direction parallel to the axis of rotation of the wheel 31 itself and each of which is able to be inserted into a bottom portion of a respective outlet opening 28, axially extract a respective group 29 of cigarettes 27 and insert it into a compartment 30 of the wheel 31. During the action of each of the pusher elements, the same number of counterpushers, not illustrated, which move with reciprocating motion in a direction parallel to the axis of rotation of the wheel 31, slide inside the compartments 30 into which respective groups 29 are being inserted in order to align the axial ends of the groups 29 being inserted by aligning the ends of the selfsame groups 29 opposite to those adjacent to the pusher elements.

Each time it rotates by one step, the wheel 31 brings in succession a group 29 of cigarettes 27 towards a station 32 for transferring the groups 29 into respective hollow mandrels 33, which are substantially in the shape of a parallelepiped and which are spaced at equal angular intervals around the periphery of a wrapping wheel 34 rotating stepwise in a clockwise direction about a horizontal axis parallel to the axis of rotation of the wheel 31.

The transfer of each group 29 into a mandrel 33 is effected, during a dwell of the wheels 31 and 34, by pusher elements not illustrated, of essentially known type, which push the group 29 axially in order to extract it from a compartment 30 of the wheel 31 and insert it into a respective mandrel 33.

The wheel 34 is equipped with twelve radial spokes 35, each of which mounts one of the mandrels 33 in cantilever fashion. Each mandrel 33 is open at the ends of it and is oriented with its longitudinal axis parallel to the axis of rotation of the wheel 34. The packets P are formed by folding respective sheets 36 of metallized paper or foil, and then blanks S2, S3, S4 or S5, around each mandrel 33, a group 29 of cigarettes 27 being fed into the mandrel 33 after the respective blank S2, S3, S4 or S5 has been folded around it.

Figure 8:
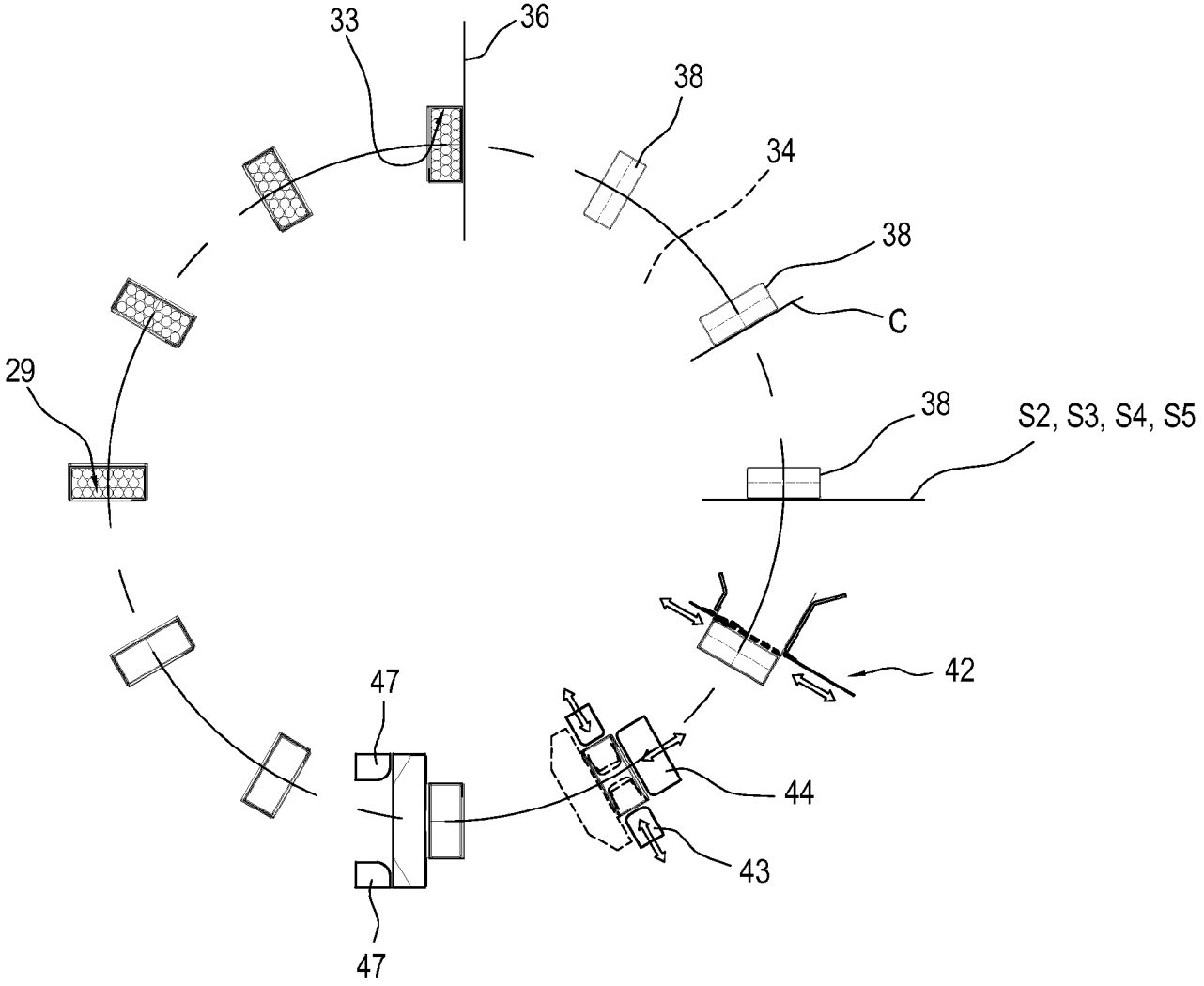
FIG. 8 schematically illustrates a wrapping cycle by which a cigarette packet according to this invention is made.

The operating steps of the machine 25, which is described in more detail below, are also identifiable in the wrapping cycle schematically illustrated in FIG. 8, representing the construction of a cigarette packet P according to this invention.

Associated with each mandrel 33 there are retaining means of known type, not illustrated, acting in conjunction with the flanks of the mandrel 33 itself and located at the front and at the back, with reference to its feed direction. These retaining means are capable, as explained below, of holding a sheet 36, fed in known manner, in contact with each mandrel 33, as shown in FIG. 6, at a station 37 located at an upper zone of the wheel 34, to form a container 38 to be placed in direct contact with a group 29, of cigarettes 27.

In use, the wheel 34, is made to rotate stepwise in the direction indicated by the arrow F in FIG. 6 by angular steps of 30°, alternating the rotation steps with dwell steps. Around the wheel 34, there are several operating stations where each mandrel 33 is carried as the wheel 34 rotates in successive steps in order to perform successive operations for forming the packet P.

After a sheet 36 has been placed in contact with the front wall of each mandrel 33, with reference to the direction of rotation of the wheel 34, folding means not illustrated, of known type, wrap the sheet 36 onto the mandrel 33 in such a way that the folded sheet 36 surrounds it around all four of its lateral surfaces and its axial end surface furthest away from the wheel 34.

At a station 39, feed means of known type, not illustrated, place an inner frame C in contact with each container 38 just made by folding a sheet 36 around a mandrel 33. Suitable stop elements of known type, not illustrated, hold the inner frames C just fed in contact with the respective containers 38.

At a station 41, further feed means 40, shown only partly, place in known manner, in contact with each container 38 which has just received an inner frame C, a blank S2 or S3, a portion of which is held in a manner not illustrated in contact with a front wall of the container 38 itself, with reference to the direction of rotation of the wheel 34. If blanks S4 or S5 incorporating an inner frame 22 are used, the feeding step by which the inner frames C are placed in contact with the containers 38 is omitted.

Each blank S2, S3, S4 or S5 which reaches the station 41 already has adhesive material smeared on specific parts of it by gluing means of known type, not illustrated.

Each blank S2, S3, S4, S5 is preferably carried to the station 41 with its rectangular panel 15 folded by 180° about the weakened line 14 and pressed against the rectangular panel 13 adjacent thereto by folding means of known type, not illustrated, in such a way that the selfsame rectangular panel 15, constituting the reinforcing flap is located inside the lid 4' of the packets P when assembled.

At a folding station 42 located downstream of the station 41 with reference to the direction of rotation of the wheel 34, folding means of known type, not illustrated, fold the blank S2, S3, S4 or S5 around the container 38, surrounding in essentially known manner the lateral surfaces thereof with the panels 1, 2, 3 and 4 (whichever of the blanks S2, S3, S4 or S5 is used). More precisely, the panels 1, 2, 3 and 4 are folded around the container 38 along lines (or groups of lines running side by side if the packet P has rounded longitudinal edges) parallel to the longitudinal dimension of the packet P to be made, that is to say, to the line joining the top and base panels of the packets P.

If the blank used is the one denoted by the reference characters S4 in FIG. 4, the blank S4, while it is being folded around the mandrels 33, is first subjected to folding of its panel 4*b* against the mandrel 33, and then the panels 18 and 21 forming part of the inner frame 22 are also folded against the mandrel 33 in that order, and only after that, the panels 3, 2 and 4 are folded against the mandrel 33 in that order.

Figure 5A:
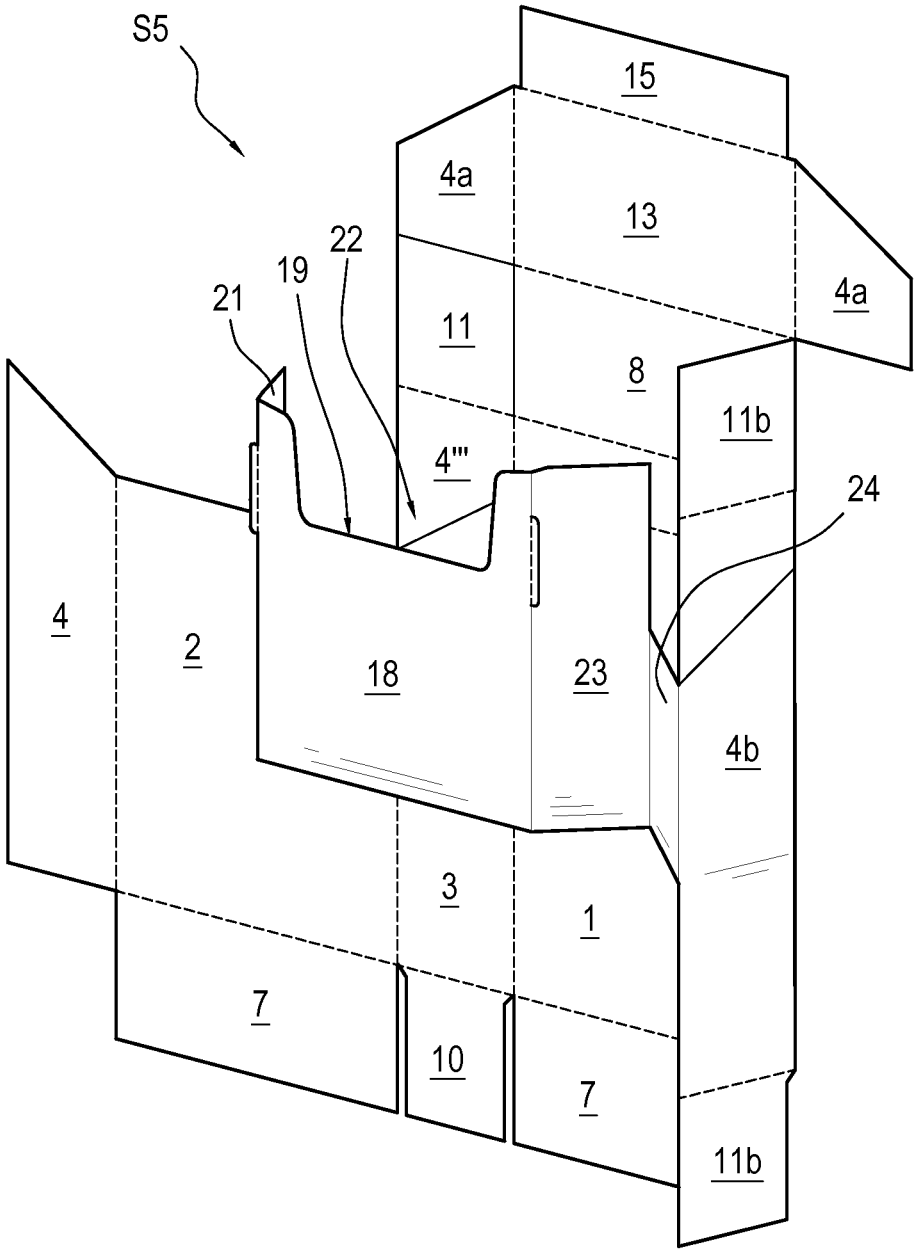

If the blank used is the one denoted by the reference characters S5 in FIG. 5, as shown better in FIG. 5*a* and as mentioned previously, a lateral panel 23 of the inner frame 22 is connected to a lateral portion of the panel 1 by two interposed panels 4*b*, 24 which are mutually connected by a weakened folding line, the assembling of the inner frame 22 comprising folding in a Z shape along the folding lines the lateral panel 4*b* and the two mutually connected panels 23, 24.

Obviously, as mentioned above, if the machine 25 uses blanks S4 or S5 incorporating the inner frame 22, the machine 25 need not be equipped with the feed means by which the inner frames C are placed in contact with each container 38 which has just been folded around a mandrel 33, and if the machine 25 is equipped with such feed means, they must be disabled.

Whatever the blank S2, S3, S4 or S5 used, the rectangular panels 1, 2, 3 *e* 4 and the trapezoidal flaps 4''' used for making the lid 4' of the packet P, after the blank S2, S3, S4 or S5 has been partly folded as described above, are located outside the respective mandrel 33, projecting away from the wheel 34 in a direction parallel to the axis of rotation of the wheel 34 itself. In a variant embodiment of this invention not illustrated, the mandrels 33 might extend axially in a radial direction relative to the wheel 34 which supports them and, in this case, the rectangular panels 1, 2, 3 and 4 and the trapezoidal flaps 4''' used for making the lid 4' of the packet P, after the blank S2, S3, S4 or S5 has been partly folded as described above, would be located outside the respective mandrel 33, projecting away from the wheel 34 in a direction perpendicular to the axis of rotation of the wheel 34 itself.

Suitable folding elements of known type, not illustrated, operating at a station 43 where each packet P being formed is brought to stop, then fold the upper flaps 10 and 11 of the blank S2, S3, S4 or S5 at an angle against the top end of the container 38.

Further folding elements of essentially known type, located at the station 43 and represented schematically in the form of a panel 44 movable in both directions perpendicularly to the panel 1, fold the panel 8 squarely into contact with the top end of the container 38 of each packet P which is being formed and which has stopped at the station 43 itself. Another folding element of essentially known type, located at a station 45 and represented schematically in the form of a panel 46 movable in both directions parallel to the axis of rotation of the wheel 34, folds the panel 13 squarely into contact with a front upper portion of the container 38 of each packet P which is being formed and which has stopped at the station 45 itself.

At the start of each step of moving the wheel 34, further folding means of essentially known type, located substantially at the station 45 and represented schematically in the form of two fixed opposing elements 47, fold squarely against respective right-angled trapezoidal portions 4''' the two trapezoidal flaps 4*a* of a packet P being formed as it starts moving away from the station 45.

As illustrated by way of example in FIG. 6, the panels 44 and 46 and the opposing elements 47 are positioned outside the path followed by the mandrels 33, although, in an embodiment of the invention not illustrated, they might be carried by the wheel 34. In the case where they are positioned outside, the folding means comprising the panels 44 and 46 and the opposing elements 47 can be retrofitted on the machine 25, meaning that they can easily be added to an existing machine which does not have them.

After going past the station 45, the packets P carried by the mandrels 33 are still open at the axial ends of the blank S2, S3, S4 or S5 and sheet 36, adjacent the zone where the mandrels 33 they are folded around are attached to the wheel 34, whereas their sides and lids 4' are complete. Downstream of the station 45, a few further rotation steps of the wheel 34 cause the packets P being formed to be carried in succession to the aforementioned station 37 where, as stated above, the sheets 36 are placed in succession in contact with the respective mandrels 33.

At this station, as better illustrated in FIG. 7, each time the wheel 34 dwells, a pusher element 48 which moves with reciprocating motion in a direction parallel to the axis of rotation of the wheel 34, cyclically withdraws the still incomplete packets P from the mandrels 33 by coming into abutment with their open ends and pushing them, together with the cigarettes 27 still inside the selfsame mandrels 33, onto a ledge 49 where the packets P are closed. As soon as each packet P is withdrawn from a mandrel 33, a sheet 36 to be used to make another packet P is placed in contact with that mandrel 33.

Completion of the closure of the packets P just withdrawn from respective mandrels 33, which also involves the respective sheets 36, is performed by folding means 50 of essentially known type which first fold the bottom flaps 10 and 11 of the blank S2, S3, S4 or S5 squarely against the bottom of the container 38 and immediately after that fold panel 7 adjacent to the panel 1 squarely around the folding line which separates the panels 1 and 7 themselves until bringing it into contact with the flaps 10 and 11, and then fold the panel 7 adjacent to the panel 2 squarely around the folding line which separates the panels 2 and 7 themselves until bringing it into contact with the panel 7 just folded. During each action of the pusher element 48, a counterpusher, not illustrated, which moves with reciprocating motion in a direction parallel to the axis of rotation of the wheel 34 moves alongside the lids 4' of the packets P to better define the instantaneous positions of the packets P themselves. The adhesive substance already present on one of the panels 7, as mentioned above, causes the panels 7 to adhere to each other.

A pusher element 51 having a horizontal line of action perpendicular to the axis of rotation of the wheel 34 then causes each completed packet P to be transferred onto a horizontal ledge 52 juxtaposed with the ledge 49, delimited on two sides parallel to the line of action of the pusher element 51 by two vertical side pieces 53, which guide and stabilize the shape of the packets P moving one after the other between them. If necessary, heating means (not illustrated) may be provided at any point in the packing line, in particular at the ledges 49 and 52 and at the side pieces 53, in order to facilitate drying of the adhesive substance between adjacent portions of the blanks S2, S3, S4 or S5.

It should be noted that the packing machine 25 described above might operate with blanks S2, S3, S4 or S5 with a layer of metallized paper already attached to the inside of them, for example by gluing, and in that case, the packing machine 25 would not need to be equipped with the mechanical means necessary for feeding and folding the above mentioned sheet 36 of metallized paper.

What is claimed is:

1. A method for making hinged-lid packets for smoking articles in a packing machine, comprising:

feeding groups of smoking articles into respective compartments of a first conveyor which moves with intermittent motion;

feeding sheets of wrapping material into contact with respective hollow mandrels carried by a second conveyor which moves with intermittent motion;

partly folding each sheet of wrapping material around one of the respective hollow mandrels along folding lines parallel to a direction of longitudinal extension of the one of the respective hollow mandrels to form a partly finished container having four lateral panels substantially reproducing a shape and size of corresponding lateral surfaces of the one of the respective hollow mandrels and adhering to those lateral surfaces;

feeding blanks of wrapping material into contact with respective sheets of wrapping material which are partly folded around the respective hollow mandrels, each blank having four panels extending side by side in pairs along a direction perpendicular to a direction of longitudinal extension of a packet obtainable from the blank and substantially reproducing a shape and size of corresponding lateral panels of the sheet of wrapping material adjacent to the blank; the blank being foldable along folding lines made between the pairs of panels and parallel to the direction of longitudinal extension; an upper portion of one of the four panels being integral, on an exterior of the four panels, with a portion for forming the hinged lid of the respective packet; the portion for forming the hinged lid comprising, a plurality of lid panels extending in succession from the one of the four panels integral with the portion for forming the hinged lid; the plurality of lid panels of the portion of the blank for forming the hinged lid being arranged in succession along the direction of longitudinal extension and comprising at least a first lid panel, defining a top panel of the hinged lid of the packet, a second lid panel connected to the first lid panel and defining a front panel of the hinged lid of the packet, and a third lid panel configured as a last lid panel of the plurality of lid panels and connected to the second lid panel by a respective folding line;

partly folding each blank around the respective sheet of wrapping material along folding lines parallel to the direction of longitudinal extension to form a partly finished packet having four lateral panels forming part of the blank and respectively superposed on the four lateral panels of the container obtained from the sheet and substantially reproducing the shape and size of those lateral panels;

transferring axially and in succession the groups of smoking articles from the compartments of the first conveyor into the respective hollow mandrels of the second conveyor; and removing the partly finished packets in succession from the respective hollow mandrels and completing the folding of the respective sheet and of the respective blank;

before removing each partly finished packet from the one of the respective hollow mandrels, folding the portion for forming the hinged lid of each blank to form the lid, wherein the folding of the portion for forming the hinged lid comprises folding the third lid panel by 180° around the respective folding line so that the third lid panel rests against the second lid panel on an interior of the packet.

2. The method according to claim 1, wherein, during the partly folding each blank around the respective sheet of wrapping material, also folding around the sheet an inner frame or element inside the packet, which is connected to a lateral portion of one of the four panels of the blank by a weakened folding line.

3. The method according to claim 2, wherein, a lateral panel of the inner frame is connected to the lateral portion of one of the four lateral panels by two interposed panels which are mutually connected by a weakened folding line, and further comprising assembling the inner frame by folding in a Z shape along the weakened folding lines the lateral panel of the inner frame and the two mutually connected panels.

4. The method according to claim 3, and further comprising folding the portion for forming the hinged lid of each blank with a folding mechanism positioned outside the path followed by the respective hollow mandrels.

5. The method according to claim 4, and further comprising associating the folding mechanism with the packing machine as a retrofit.

6. The method according to claim 2, and further comprising folding the portion for forming the hinged lid of each blank with a folding mechanism positioned outside the path followed by the respective hollow mandrels.

7. The method according to claim 6, and further comprising associating the folding mechanism with the packing machine as a retrofit.

8. The method according to claim 1, and further comprising folding the portion for forming the hinged lid of each blank with a folding mechanism positioned outside the path followed by the respective hollow mandrels.

9. The method according to claim 8, and further comprising associating the folding mechanism with the packing machine as a retrofit.

10. The method according to claim 1, and further comprising associating the folding mechanism with the packing machine as a retrofit.

* * * * *